US006338638B2

(12) United States Patent
Kodama

(10) Patent No.: US 6,338,638 B2
(45) **Date of Patent: *Jan. 15, 2002**

(54) ELECTRIC CONNECTOR AND TERMINAL

(75) Inventor: Shinji Kodama, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/437,830

(22) Filed: Nov. 10, 1999

(30) Foreign Application Priority Data

Nov. 12, 1998 (JP) ..... 10-321902
Oct. 5, 1999 (JP) ..... 11-284019

(51) Int. Cl.[7] ..... H01R 13/64; H01R 13/40; H01R 13/502; H01R 13/514

(52) U.S. Cl. ..... 439/246; 439/595; 439/701

(58) Field of Search ..... 439/595, 246, 439/596, 701

(56) References Cited

U.S. PATENT DOCUMENTS 5,458,426 A * 10/1995 Ito ..... 403/274
5,573,430 A * 11/1996 Hatagishi ..... 439/701
5,628,652 A * 5/1997 Ohsumi ..... 439/595
5,716,235 A * 2/1998 Endo et al. ..... 439/596
5,788,536 A * 8/1998 Matsuura et al. ..... 439/595
6,024,605 A * 2/2000 Beck, Jr. et al. ..... 439/595
6,033,262 A * 3/2000 Heimueller et al. ..... 439/595

FOREIGN PATENT DOCUMENTS

JP 10-189102 7/1998

* cited by examiner

*Primary Examiner*—P. Austin Bradley
*Assistant Examiner*—Edwin A. León
(74) *Attorney, Agent, or Firm*—Armstrong, Westerman, Hattori, McLeland & Naughton, LLP

(57) ABSTRACT

An electric connector with a terminal is provided, which includes: a first electric connector having a connector housing in which a terminal accommodating chamber is formed; a second electric connector with a second terminal; a first terminal to be accommodated in the connector housing and to be connected with an electric wire; an electrical contact section provided on the first terminal and having a contact piece to be electrically connected with the second terminal; a wire connection section provided on the first terminal for connecting an electric wire; and a space provided between the electrical contact section and an inner surface of the terminal accommodating chamber for allowing relative movement between the electrical contact section and the connector housing. The space is formed by making a step between a bottom of the electrical contact section and a bottom of the wire connection section. And, the first terminal is provided with an elastic vibration-absorbing portion between the electrical contact section and the wire connection section. Thus, an electric connector with a terminal wherein abrasion, caused by vibration, of contact points of the first and second terminals and increase of electrical resistance at the contact points do not arise can be realized.

6 Claims, 5 Drawing Sheets

ELECTRIC CONNECTOR AND TERMINAL

BACKGROUND OF THE INVENTION

1. Field of the Invention

The present invention generally relates to an electric connector assembly for connecting electric wires and more particularly, to an electric connector with a terminal, wherein abrasion of electric contact points due to small vibration friction does not arise.

2. Description of the Related Art

An electric connector assembly is often used in such circumstances as motor vehicle or the like, wherein vibration acts on the electric connector assembly. In such a case, since small vibration friction could arise at electric contact points between an electric connector and a mating electric connector, the contact points would abrade and, therefore, electrical resistance at the contact points would increases.

Therefore, an electric connector capable of preventing such abrasion due to small vibration friction has been proposed. For example, FIG. 4 shows a prior art terminal β for an electric connector disclosed in Japanese Patent Application Laid-open No. 10-189102 (hereinafter JP '102).

This terminal β is accommodated in a terminal accommodating chamber of a connector housing, thereby making up an electric connector, and consists of a electrical contact section 1 provided for connecting with a terminal (not shown) of a mating electric connector and a wire connection section 2 provided for fixing an electric wire. The wire connection section 2 has a conductor crimping portion 21 and a cover crimping portion 22.

The terminal β is made by punching a sheet material and by bending it, as is shown in FIGS. 4 and 5. The electrical contact section 1 is in a box-like shape and has an elastic contact piece 12 therein supported by a linking portion 11.

FIG. 6 is a longitudinal sectional view, taken along a line A—A in FIG. 4, of the prior art terminal. The elastic contact piece 12 is electrically connected with a terminal (not shown) of a mating electric connector at contact portions 12*a* and 12*b*.

As described above, since the elastic contact piece 12 is supported by the box-like portion of the terminal β only by means of the linking portion 11, small vibration friction between the contact portions 12*a* and 12*b* and the terminal of the mating electric connector would be prevented.

With respect to the above terminal β of JP '102, however, though the above structure with the linking portion 11 exhibits the vibration absorbing effect in b-direction (vertical direction) and c-direction (lateral direction) shown in FIGS. 4 and 6, the effect is not exhibited in a-direction (longitudinal direction) shown in FIG. 4. Specifically, the elastic contact piece 12 rotatively vibrates about the linking portion 11, as shown in FIG. 7. And, strictly speaking, since the elastic contact piece 12 rotates vertically (in the b-direction) about the linking portion 11, the mating terminal (a tab portion) 9 is apt to be hit by the elastic contact piece 12, thereby causing abrasion of the mating terminal. That is, since the vibration absorbing effect is incomplete in the above structure, the small vibration friction has not been solved.

On the other hand, FIGS. 8A and 8B are longitudinal sectional views showing typical conventional locking methods of a terminal to a connector housing. A terminal β in FIG. 8A is locked, at the end of a box-like electrical contact section, by an elastic lance 41' provided on a connector housing 4', and a terminal β' in FIG. 8B is locked by engaging an elastic engaging piece 19, projecting from a electrical contact section, with a step portion 41" provided in a connector housing 4".

Since the electrical contact sections of the terminals β,β' are directly put into contact with the connector housings 4',4", vibration of the connector housings 4',4" is propagated to the electrical contact sections. Therefore, small vibration friction or hitting movement between mating terminals (not shown) and the electrical contact sections would arise and abrasion of the electrical contact sections would arise.

SUMMARY OF THE INVENTION

In view of the foregoing, an object of the present invention is to provide an electric connector with a terminal wherein abrasion of electric contact points due to small vibration friction does not arise and, more particularly, to provide an electric connector with a terminal wherein, in a vibrating state of connector housing, small vibration friction in a terminal longitudinal direction can be prevented and simultaneously abrasion of the terminal due to vertical vibration (i.e. in a thickness direction of a tab portion of the terminal) can be still surely prevented.

In order to achieve the above-described object, as a first aspect of the present invention, an electric connector includes: a first electric connector having a connector housing in which a terminal accommodating chamber is formed; a second electric connector with a second terminal; a first terminal to be accommodated in the connector housing and to be connected with an electric wire; an electrical contact section provided on the first terminal and having a contact piece to be electrically connected with the second terminal; a wire connection section provided on the first terminal for connecting an electric wire; and a space provided between the electrical contact section and an inner surface of the terminal accommodating chamber for allowing relative movement between the electrical contact section and the connector housing, whereby abrasion, caused by vibration, of contact points of the first and second terminals and increase of electrical resistance at the contact points do not arise.

According to the above-described structure, since the electrical contact section does not vibrate even in case that the connector housing vibrates in a direction perpendicular to the terminal connection direction, small vibration friction (hitting abrasion) between the terminal and the mating terminal can be prevented, thereby preventing poor contact of the terminals or an increase of electrical resistance.

As a second aspect of the present invention, in the structure with the above first aspect, the space is formed by making a step between a bottom of the electrical contact section and a bottom of the wire connection section.

According to the above-described structure, the conventional connector housing can be utilized, thereby saving the cost.

As a third aspect of the present invention, in the structure with the above first aspect, the first terminal is provided with an elastic vibration-absorbing portion between the electrical contact section and the wire connection section.

According to the above-described structure, since the electrical contact section can independently move relatively to the wire connection section, abrasion of the contact portions of the terminals can be surely prevented.

As a fourth aspect of the present invention, in the structure with the above first aspect, the wire connection section is provided with an engaging portion for preventing the first terminal form coming out of the terminal accommodating chamber.

According to the above-described structure, since the wire connection section is fixed to the connector housing and the electrical contact section is free in the space, propagation of vibration toward the electrical contact section can be surely prevented.

As a fifth aspect of the present invention, in the structure with the above third aspect, the elastic vibration-absorbing portion has an elasticity in a terminal connection-disconnection direction.

According to the above-described structure, since the vibration-absorbing portion can absorb vibration in the terminal connection-disconnection direction, small vibration friction between the terminal and the mating terminal can be prevented, thereby preventing poor contact of the terminals or an increase of electrical resistance.

As a sixth aspect of the present invention, in the structure with the above first aspect, the electrical contact section is provided with the contact piece by means of an elastic linking portion.

As a seventh aspect of the present invention, in the structure with the above sixth aspect, the electrical contact section has a rectangular tube portion and the linking portion links the rectangular tube portion and the contact piece.

According to the structure with above sixth or seventh aspect, since the contact piece can rotate about the linking portion, small vibration friction of the terminal can be still surely prevented.

As an eighth aspect of the present invention, a terminal includes: an electrical contact section having a contact piece to be electrically connected with a mating terminal; a wire connection section for connecting an electric wire; and a step formed between a bottom of the electrical contact section and a bottom of the wire connection section, wherein the bottom of the electrical contact section is positioned nearer a longitudinal axis of the terminal than the bottom of the wire connection section.

According to the above-described structure, since the space is formed by means of the step, the same effect as that of the structure with the above first aspect can be attained when the terminal is set in the connector housing.

As a ninth aspect of the present invention, a terminal includes: an electrical contact section having a contact piece to be electrically connected with a mating terminal; a wire connection section for connecting an electric wire; and an elastic vibration-absorbing portion provided between the electrical contact section and the wire connection section.

As a tenth aspect of the present invention, in the structure with the above eighth aspect, an elastic vibration-absorbing portion is provided between the electrical contact section and the wire connection section.

According to the structure with above ninth or tenth aspect, the same effect as that of the structure with the above third or fifth aspect can be attained when the terminal is set in the connector housing.

As a whole, according to the above-described structures of the present invention, even though the connector housing vibrates, propagation of the vibration to the contact piece is prevented. Since small vibration friction between the contact portions of the contact piece and the mating terminal of the mating electric connector can be prevented, abrasion of the contact points of the terminals can be prevented even under circumstances of vibration and, therefore, an increase of electrical resistance at the contact points can be prevented.

The above and other objects and features of the present invention will become more apparent from the following description taken in conjunction with the accompanying drawings.

DESCRIPTION OF THE PREFERRED EMBODIMENTS

It is required to provide the space between the wall surface of the terminal accommodating chamber and the electrical contact section for the connector in accordance with the present invention. With this structure, propagation of ambient vibration to the contact piece is reduced, whereby small vibration friction between the contact piece and the terminal of the mating electric connector can be got rid of. Here, it would be desirable that no contact point exists between the wall surface of the terminal accommodating chamber and the electrical contact section. If spaces are arranged so that the electrical contact section of the terminal is not put into contact with the wall surface of the terminal accommodating chamber at three surfaces or more of the electrical contact section, for example, in case that the electrical contact section of the terminal is in a shape of a rectangular solid, sufficient effect can be got.

In the present invention, provision of a terminal having a vibration absorbing portion between the electrical contact section and the wire connection section is effective in attenuating propagation, in the connecting direction, of ambient vibration to the contact piece. Here, the vibration absorbing portion can be formed by lowering rigidity of the portion by making the portion slender, by making the portion thin, by providing a number of small holes on the portion, or the like.

And, the terminal to be accommodated in the terminal accommodating chamber of the electric connector in accordance with the present invention is provided with an engaging portion to prevent the terminal from coming out of the terminal accommodating chamber of the connector housing, and the engaging portion is preferably provided on the wire connection section of the terminal. With this structure, propagation of ambient vibration to the contact piece can be further lowered.

In the present invention, as another means for lowering propagation of ambient vibration to the contact piece to be connected with the terminal of the mating electric connector, for example, the electrical contact section consists of a base plate portion, a contact piece located above the base plate portion and to be electrically put into contact with the terminal of the mating electric connector, and a contact piece linking portion which is narrowly formed and links a rectangular tube portion including the base plate portion and the contact piece. Combined structure of this structure and the previous one can prevent the small vibration friction from arising.

An embodiment of the present invention will now be described in further detail with reference to the accompanying drawings.

Figure 1:
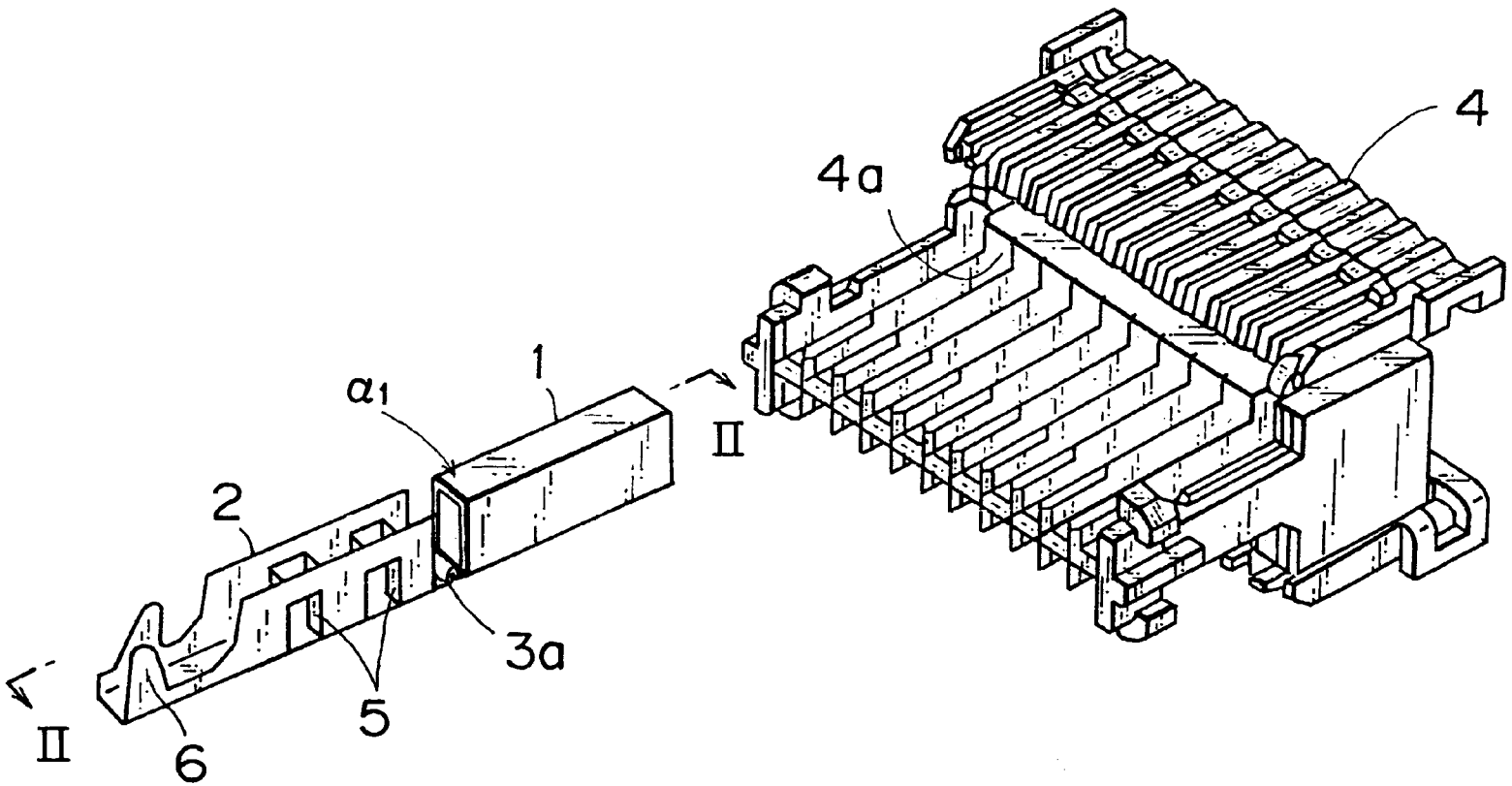
FIG. 1 is a perspective view showing an electric connector, consisting of a connector housing and a terminal, in accordance with the present invention.

FIG. 1 is a perspective view showing an embodiment of an electric connector, consisting of a connector housing and a terminal, in accordance with the present invention.

Reference numeral α1 indicates an embodiment of a terminal in accordance with the present invention. The terminal α1 is made by punching a copper sheet and by bending it. The terminal α1 is accommodated in a terminal accommodating chamber 4*a* of a connector housing 4 one by one, which constitutes the electric connector.

The terminal α1 has a box-like electrical contact section 1 at the one side and a wire connection section 2, at the other side, consisting of a wire pressure welding portion 5 and a wire fixing piece 6. The electrical contact section 1 and the wire connection section 2 are connected by a spring portion 3*a* being in a substantially reversed-U shape and acting as an elastic vibration absorbing portion. An electric wire (not shown) is pressure-welded to a wire pressure welding portion 5 from the upper side and fixed by a wire fixing piece 6.

Figure 2:
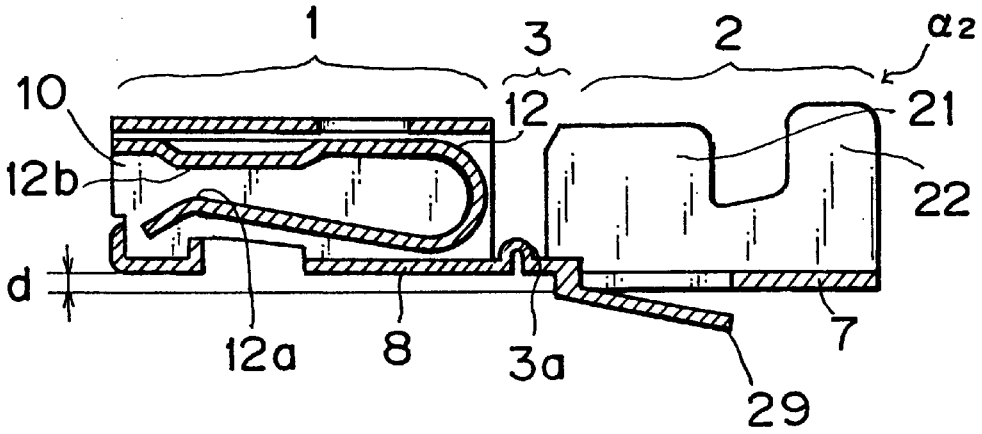
FIG. 2 is a longitudinal sectional view of another embodiment of a terminal in accordance with the present invention.

FIG. 2 is a longitudinal sectional view of another embodiment of a terminal in accordance with the present invention;

As shown in FIG. 2, a terminal α2 has a electrical contact section 1 with an elastic contact piece 12 which is applied to connection with a terminal (not shown) of a mating electric connector, a wire connection section 2 to be applied to fixation of an electric wire, and a vibration absorbing portion 3 provided between the electrical contact section 1 and the wire connection section 2. Referring to FIG. 2, the vibration absorbing portion 3 is of a spring portion 3*a* formed by bending the copper sheet. Since rigidity is lowered locally at the spring portion 3*a*, propagation of vibration from the wire connection section 2 to the electrical contact section 1 is greatly lowered. Especially, vibration propagation effect in the terminal inserting direction is remarkably high.

The wire connection section 2 is provided with wire crimping portions 21 and 22 and is bent to fix the electric wire. And, a step d is formed between a bottom portion of the wire connection section 2 and a bottom portion of the electrical contact section 1, which forms a space between the bottom portion of the electrical contact section 1 and a bottom surface of the terminal accommodating chamber 4*a* of the connector housing 4, as described later.

Figure 8A:
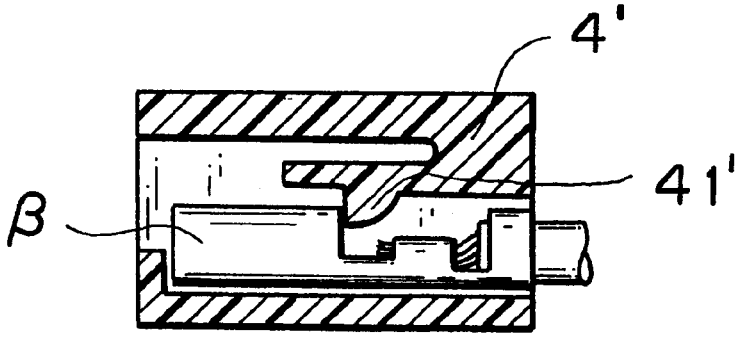
FIG. 8A PRIOR ART
FIGS. 8A and 8B are longitudinal sectional views showing typical conventional locking methods of a terminal to a connector housing.
Figure 8B:
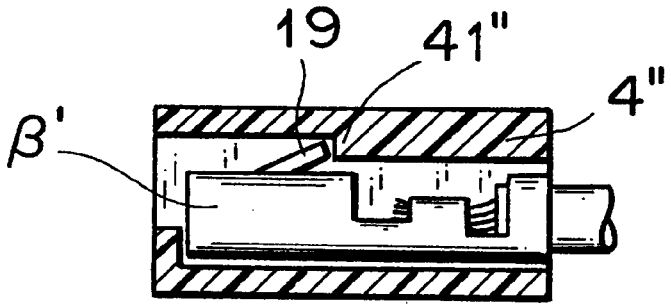
FIG. 8B PRIOR ART

Further, since an engaging piece (an engaging portion) 29 which prevents the terminal α2 from coming out of the terminal accommodating chamber 4*a* of the connector housing 4 is provided on a base plate portion 7 of the wire connection section 2, vibration of the connector housing 4 side is propagated to the electrical contact section 1 through the wire connection section 2, and therefore energy of vibration is greatly reduced. On the other hand, since a conventional engaging portion is provided on the electrical contact section of the terminal β or of the terminal if β' as shown in FIG. 8A or FIG. 8B, propagation of vibration to the contact piece is very big.

Figure 5:
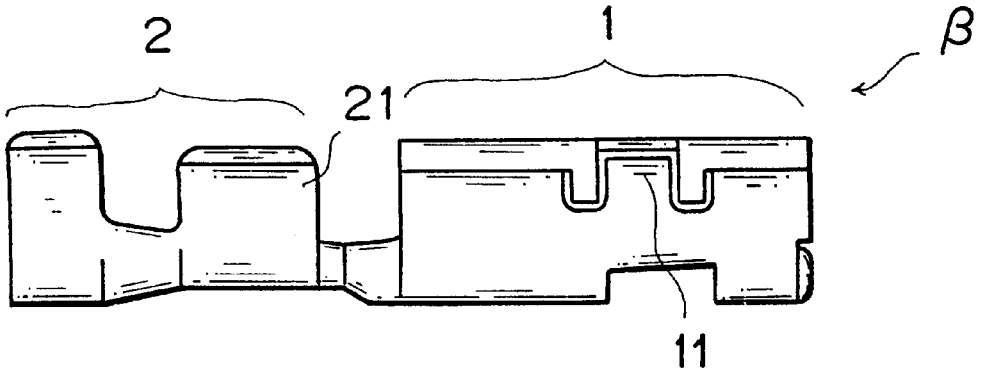
FIG. 5 PRIOR ART
FIG. 5 is a side view of the prior art terminal of FIG. 4.
Figure 6:
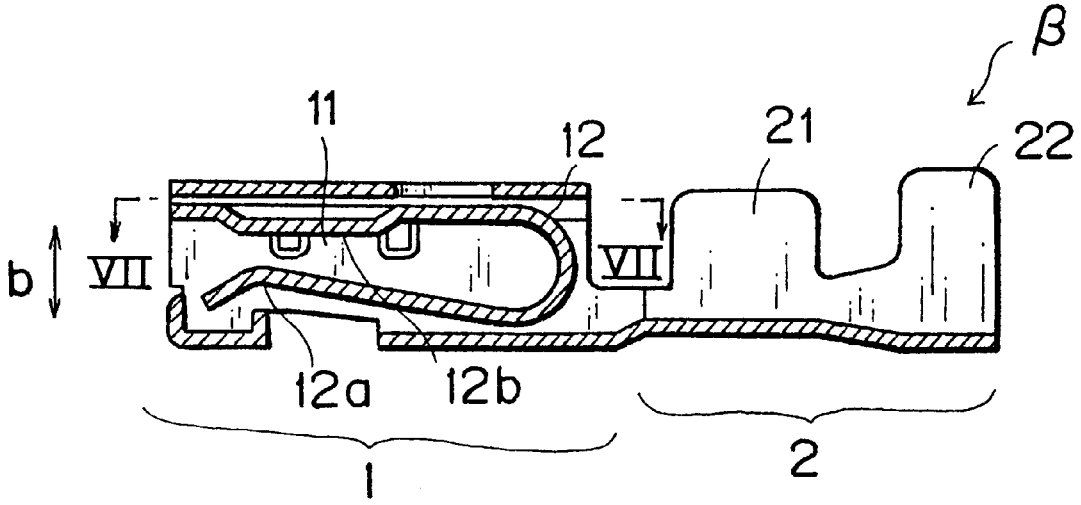
FIG. 6 PRIOR ART
FIG. 6 is a longitudinal sectional view, taken along a line A—A in FIG. 4, of the prior art terminal.
Figure 7:
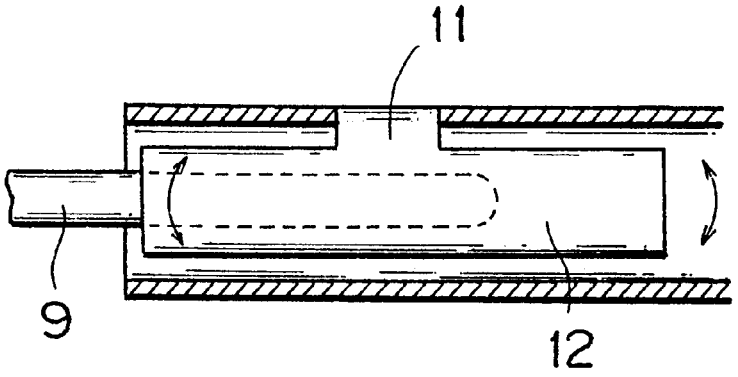
FIG. 7 PRIOR ART
FIG. 7 is a longitudinal sectional view, taken along a line B—B in FIG. 6, of the prior art terminal.

The electrical contact section 1 of the present invention consists of a rectangular tube portion having a rectangular cross-section, an elastic contact piece 12 accommodated in the rectangular tube portion and to be put into contact with the terminal (not shown) of the mating electric connector so as to electrically connect therewith, and a narrow linking portion (not shown; this portion has the same structure as the linking portion 11 shown in FIG. 5), as a contact piece linking portion, linking a side wall 10 of the rectangular tube portion and the elastic contact piece 12, which can effectively prevent a problem caused by small vibration friction from arising.

Figure 3:
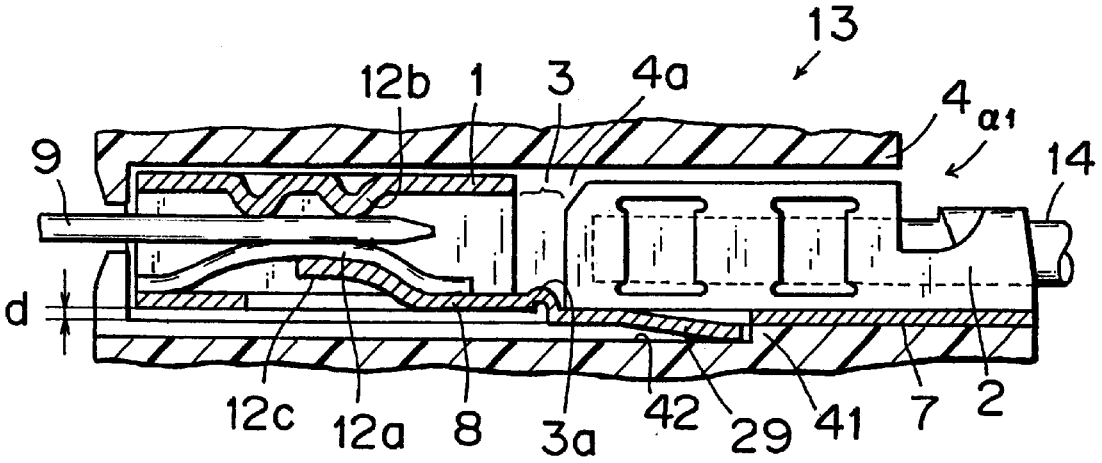
FIG. 3 is a longitudinal sectional view showing the electric connector in accordance with the present invention, wherein the terminal, taken along a line D—D in FIG. 1, is accommodated in a terminal accommodating chamber of the connector housing and the terminal is connected with a mating terminal.

FIG. 3 is a longitudinal sectional view showing the electric connector 13 in accordance with the present invention, wherein the terminal α1, taken along a line D—D in FIG. 1, is accommodated in the terminal accommodating chamber 4*a* of the connector housing 4 and the terminal α1 is connected with a mating terminal 9 (a tab portion).

In FIG. 3, parts corresponding to ones in FIG. 2 are indicated by the same reference characters or numerals as in FIG. 2.

The mating terminal 9 is electrically connected with the contact portions 12*a* and 12*b* of the elastic contact piece 12 in the elastic contact piece 12. The contact portion 12*a* is formed with an arced separate member and constitutes an elastic contact piece along with an elestic piece 12*c*. The elastic contact piece is arranged in the rectangular tube portion of the electrical contact section 1. The contact portion 12*a* is vertically movably supported by both side walls of the rectangular tube portion.

An electric wire 14 is pressure-welded to the wire connection section 2 of the terminal α1. The electrical contact section 1 and the wire connection section 2 are connected by the spring portion 3*a* being in the substantially reversed-U shape and acting as the elastic vibration absorbing portion 3. This structure permits the electrical contact section 1 to move vertically and longitudinally in the terminal accommodating portion 4*a*. Elasticity of the spring portion 3 should be weaker than connecting force between the tab portion 9 and the contact portions 12*a*,12*b*.

An elastic engaging piece 29 is provided on the front portion of the wire connection section 2, and an engaging groove 42 for the engaging piece 29 is formed on a bottom wall of the connector housing 4. The end of the engaging groove 42 is formed as a terminal locking portion 41.

And, similarly to the terminal α2 shown in FIG. 2, a step d is formed between the base plate portion 7 of the wire connection section 2 and a base plate portion 8 of the electrical contact section 1. The base plate portion 8 is positioned higher than the base plate portion 7. The step d makes a wide space (indicated with the same reference numeral d as the step) which permits relative movement between the electrical contact section 1 and the connector housing 4 in the terminal accommodating portion 4*a* of the connector housing 4. The space d (strictly, including a space over the electrical contact section 1) is preferably larger than a coupling dimensional allowance between the connector housing 4 and the mating connector housing (not shown).

As described above, the elastic contact piece 12 is linked to the rectangular tube portion of the electrical contact section 1 by means of the narrow linking portion 11. Even though the connector housing 4, i.e. the terminal accommodating chamber 4*a*, vibrates, propagation of the vibration in all directions to the elastic contact piece 12 is prevented because: the space d is provided between the electrical contact section 1 and the terminal accommodating chamber 4*a*; the engaging piece 29 is provided on the wire connection section 2; the spring portion 3*a* is provided between the electrical contact section 1 and the wire connection section 2; and, further, the elastic contact piece 12 is linked by means of the narrow linking portion 11.

That is, even in case that the connector housing 4 vibrates vertically within a range of the space d, the electrical contact section 1 does not move due to connection with the tab portion 9 of the mating connector. And, in case that the connector housing 4 vibrates longitudinally, when the connector housing 4 moves forward, only the wire connection section 2 moves forward with compression of the spring portion 3*a* in a state that the electrical contact section 1 is fixed with the mating tab portion 9. On the other hand, when the connector housing 4 moves rearward, only the wire connection section 2 moves rearward with extension of the spring portion 3*a*.

Consequently, small vibration friction between the contact portions 12*a* and 12*b* of the elastic contact piece 12 and the mating tab portion 9 and hitting movement of the tab portion 9 against the contact portions 12*a* and 12*b* can be prevented, whereby abrasion of the contact points and an increase of electrical resistance at the contact points can be prevented.

Figure 4:
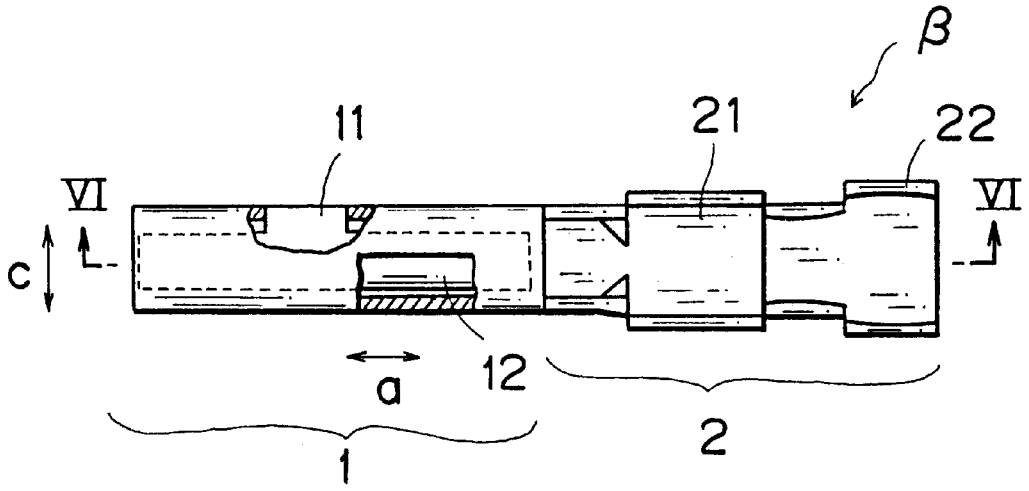
FIG. 4 PRIOR ART
FIG. 4 is a top view of a prior art terminal.

The space d may be formed in a lateral direction of the terminal. In this case, small vibration friction of the electrical contact section 1 caused by lateral vibration (i.e. in the c-direction in FIG. 4) of the connector housing 4 can be prevented.

According to the electric connector with the terminal of the present invention as described hereinabove, abrasion and the like, caused by small vibration friction, of the contact points of the terminals can be prevented even under circumstances of vibration and, therefore, an increase of electrical resistance at the contact points can be prevented.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electric connector comprising:

a first electric connector having a connector housing in which a terminal accommodating chamber is formed;

a second electric connector with a second terminal;

a first terminal to be accommodated in said connector housing and to be connected with an electric wire;

an electrical contact section provided on said first terminal and having a contact piece to be electrically connected with said second terminal;

a wire connection section provided on said first terminal for connecting an electric wire; and a space provided between said electrical contact section and an inner surface of said terminal accommodating chamber for allowing relative movement between said electrical contact section and said connector housing, said space being formed by making a step formed of an elastic curved vibration-absorbing portion extending upwardly above a bottom of said electrical contact section and connecting the bottom of said electrical contact section and a bottom of said wire connection section such that the bottom of said electrical contact section is positioned higher than the bottom of said wire connection section, whereby said electrical contact section can move upwardly and downwardly relative to said wire connection section; and whereby abrasion, caused by vibration, of contact points of said first and second terminals and increase of electrical resistance at said contact points do not arise.

2. The electric connector according to claim 1, wherein said wire connection section is provided with an engaging portion for preventing said first terminal form coming out of said terminal accommodating chamber.

3. The electric connector according to claim 1, wherein said elastic vibration-absorbing portion has an elasticity in a terminal connection-disconnection direction.

4. The electric connector according to claim 1, wherein said electrical contact section is provided with said contact piece by means of an elastic linking portion.

5. The electric connector according to claim 4, wherein said electrical contact section has a rectangular tube portion and said linking portion links said rectangular tube portion and said contact piece.

6. A terminal comprising:

an electrical contact section having a contact piece to be electrically connected with a mating terminal;

a wire connection section for connecting an electric wire; and a step formed of an elastic curved vibration-absorbing portion extending upwardly above a bottom of said electrical contact section and connecting the bottom of said electrical contact section and a bottom of said wire connection section, whereby said electrical contact section can move upwardly and downwardly relative to said wire connection section, wherein said bottom of said electrical contact section is positioned nearer a longitudinal axis of said terminal than said bottom of said wire connection section.

* * * * *